US011358762B2

(12) United States Patent
Harris et al.

(10) Patent No.: US 11,358,762 B2
(45) Date of Patent: Jun. 14, 2022

(54) CONTAINER LID

(71) Applicant: Igloo Products Corp., Katy, TX (US)

(72) Inventors: Jamison C. Harris, Brookhaven, GA (US); Nicholas J. DeKeyser, Katy, TX (US); Vincent Tsai, Quincy, MA (US)

(73) Assignee: IGLOO PRODUCTS CORP., Katy, TX (US)

( * ) Notice: Subject to any disclaimer, the term of this patent is extended or adjusted under 35 U.S.C. 154(b) by 557 days.

(21) Appl. No.: 16/346,640

(22) PCT Filed: Nov. 1, 2017

(86) PCT No.: PCT/US2017/059547
§ 371 (c)(1),
(2) Date: May 1, 2019

(87) PCT Pub. No.: WO2018/085412
PCT Pub. Date: May 11, 2018

(65) Prior Publication Data

US 2020/0055646 A1 Feb. 20, 2020

Related U.S. Application Data

(60) Provisional application No. 62/415,588, filed on Nov. 1, 2016.

(51) Int. Cl.
*B65D 47/24* (2006.01)
*A47G 19/22* (2006.01)
(Continued)

(52) U.S. Cl.
CPC ..... *B65D 47/248* (2013.01); *A47G 19/2272* (2013.01); *B65D 47/26* (2013.01);
(Continued)

(58) Field of Classification Search
CPC .. A47G 19/2272; B65D 47/248; B65D 47/26; B65D 51/1683; B65D 2205/02; B65D 2251/20
(Continued)

(56) References Cited

U.S. PATENT DOCUMENTS 3,952,914 A 4/1976 Vogt
3,964,631 A 6/1976 Albert
(Continued)

FOREIGN PATENT DOCUMENTS

KR 2012 0120884 11/2012
WO WO 2000/034143 6/2000

OTHER PUBLICATIONS

Extended European Search Report issued in application No. 17867122.8, dated Jun. 3, 2020, 8 pages, European Patent Office.

*Primary Examiner* — Vishal Pancholi
*Assistant Examiner* — Robert K Nichols, II
(74) *Attorney, Agent, or Firm* — King & Spalding LLP

(57) ABSTRACT

The disclosure provides a container lid including a resealable closure mechanism. The container lid includes a lid housing having a recess, a rim, an opening, and a connector portion. The container lid additionally contains a sliding actuator that moves in a first direction and a second direction. Further, the container lid has a sealing mechanism that moves in a third direction and a fourth direction, wherein the third direction and the fourth direction are in a plane of movement which is perpendicular to the first direction and the second direction.

4 Claims, 14 Drawing Sheets

(51) Int. Cl.
*B65D 47/26* (2006.01)
*B65D 51/16* (2006.01)

(52) U.S. Cl.
CPC ..... *B65D 51/1683* (2013.01); *B65D 2205/02* (2013.01); *B65D 2251/20* (2013.01)

(58) Field of Classification Search
USPC ..... 222/153.14, 470, 631, 153.13; 220/254, 220/203.23, 253, 254.4, 255, 264, 345.2, 220/345.4, 348, 367.1, 715, 820
See application file for complete search history.

(56) References Cited

U.S. PATENT DOCUMENTS

| | | | | |
|---|---|---|---|---|
| 4,099,642 | A | 7/1978 | Nergard | |
| 4,746,032 | A | 5/1988 | Huang | |
| 5,944,235 | A | 8/1999 | Won | |
| 6,010,029 | A | 1/2000 | Wang | |
| 6,752,287 | B1 | 6/2004 | Lin | |
| 7,413,096 | B2 | 8/2008 | Morgan et al. | |
| 8,360,258 | B2 * | 1/2013 | Gilbert | B65D 47/32 220/254.9 |
| 9,873,554 | B2 * | 1/2018 | Choltco-Devlin | B65D 45/16 |
| 9,901,199 | B2 * | 2/2018 | Maple | A47G 19/2272 |
| 10,709,270 | B2 * | 7/2020 | Joseph | B65D 43/0229 |
| 2009/0057324 | A1 | 3/2009 | Wang Wu | |
| 2015/0344199 | A1 | 12/2015 | Chiou et al. | |
| 2016/0255973 | A1 | 9/2016 | Joseph et al. | |

* cited by examiner

CONTAINER LID

CROSS REFERENCE TO RELATED APPLICATION(S)

The present application claims the benefit of U.S. Provisional Patent Application No. 62/415,588 filed Nov. 1, 2016, the entire contents of which are incorporated by reference herein.

FIELD OF THE DISCLOSURE

This disclosure relates to container lids, and more particularly, to container lids with a resealable closure mechanism.

BACKGROUND

Generally, container lids may include a mechanism for opening and closing an aperture through which fluid may enter and/or exit the container (e.g., a screw-on cap, a flip cap, etc.). To access the fluid within the container, a user would typically move or remove a portion of the cap or lid relative to the aperture of the container, so that a fluid path into the container may be provided and/or accessed. Unfortunately, such mechanisms are cumbersome and prone to spillage during the opening and/or closing action. Accordingly, solutions for providing improved resealable lid closure mechanisms are needed.

SUMMARY OF THE INVENTION

In one aspect, the disclosure provides a container lid including a resealable closure mechanism having a sliding actuator.

Definitions

Hereinafter reference will now be made in detail to various embodiments of the subject disclosure, examples of which are illustrated in the accompanying drawings and described below. While example embodiments are described, it will be understood that the present disclosure is not limited to those exemplary embodiments. On the contrary, this disclosure covers not only the embodiments described herein, but also various alternatives, modifications, equivalents and other embodiments, which may be included within the spirit and scope of the disclosure.

Ranges provided herein are understood to be shorthand for all of the values within the range. For example, a range of 1 to 50 is understood to include any number, combination of numbers, or sub-range from the group consisting of 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50, as well as all intervening decimal values between the aforementioned integers such as, for example, 1.1, 1.2, 1.3, 1.4, 1.5, 1.6, 1.7, 1.8, and 1.9. With respect to sub-ranges, "nested sub-ranges" that extend from either end point of the range are specifically contemplated. For example, a nested sub-range of an exemplary range of 1 to 50 may comprise 1 to 10, 1 to 20, 1 to 30, and 1 to 40 in one direction, or 50 to 40, 50 to 30, 50 to 20, and 50 to 10 in the other direction.

Unless specifically stated or obvious from context, as used herein, the term "about" is understood as within a range of normal tolerance in the art, for example within 2 standard deviations of the mean. "About" may be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

As used herein, the singular form "a", "an" and "the" include plural references unless the context clearly dictates otherwise.

BRIEF DESCRIPTION OF THE DRAWINGS

For a fuller understanding of the nature and desired objects of the present invention, reference is made to the following detailed description taken in conjunction with the accompanying drawing figures wherein like reference characters denote corresponding parts throughout the several views and wherein.

DETAILED DESCRIPTION OF THE INVENTION

Figure 1:
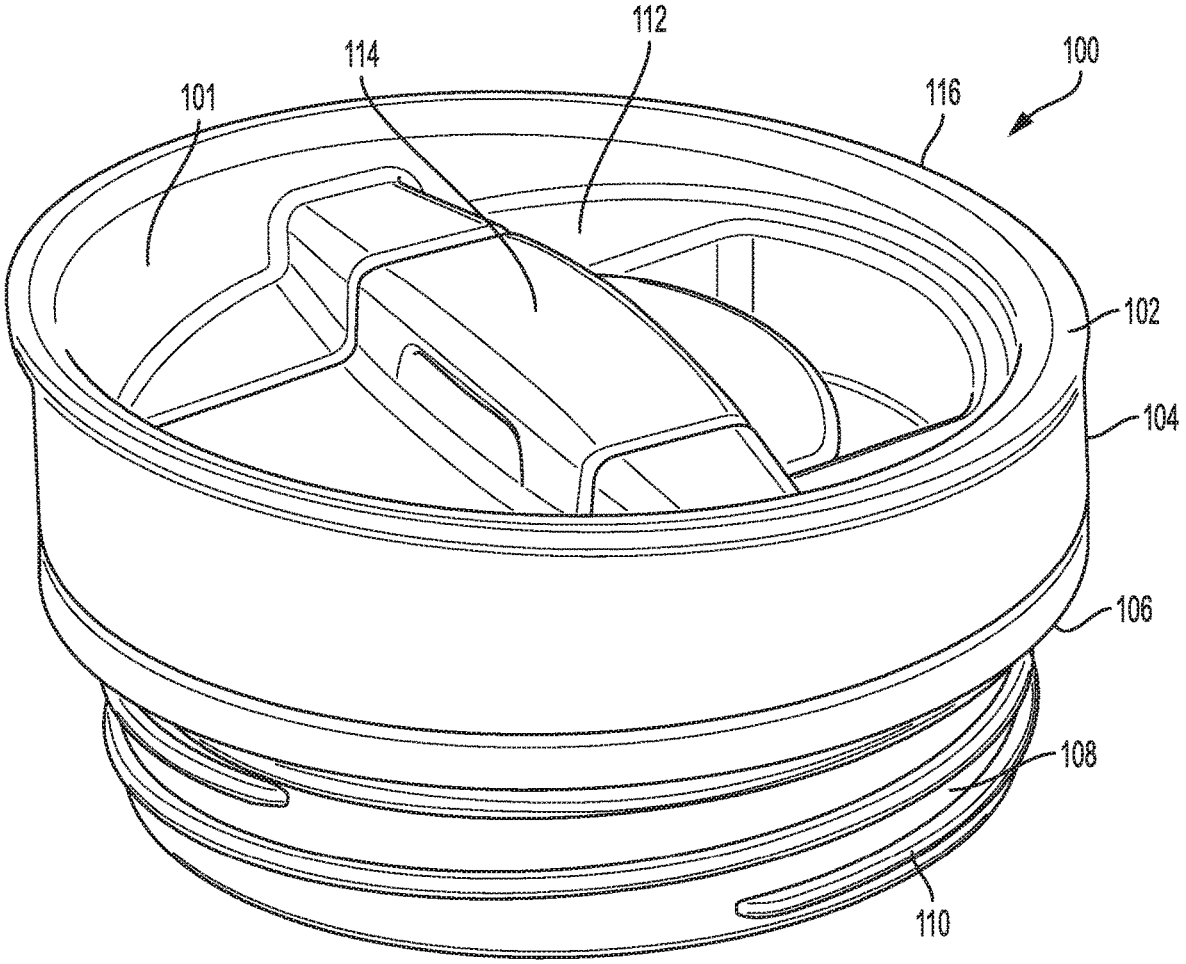
FIG. 1 provides a perspective view of a resealable container lid in a closed position according to an exemplary embodiment of the invention.

The present disclosure provides a container lid with a resealable closure mechanism. A resealable container lid according to an exemplary embodiment of the disclosure may further include a beverage container or a sports container. The present disclosure is based, at least in part, on the discovery of a resealable closure mechanism for a container lid that may be actuated via a sliding actuator such that fluid leakage through the container lid is minimized Reference will now be made to the drawings wherein like reference numerals identify similar structural aspects of the subject disclosure.

Figure 2:
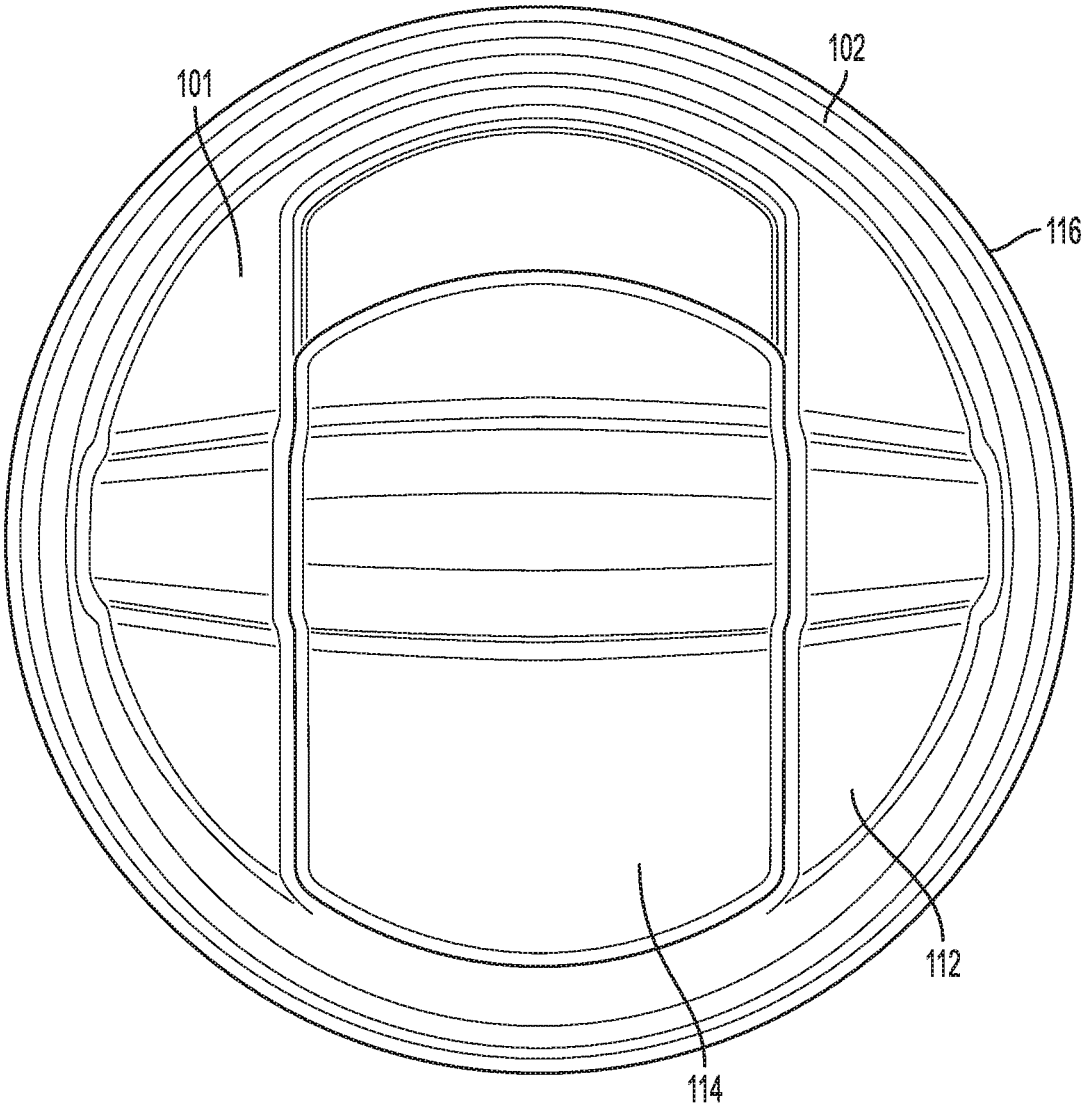
FIG. 2 provides a top view of a resealable container lid in a closed position according to an exemplary embodiment of the invention.
Figure 3:
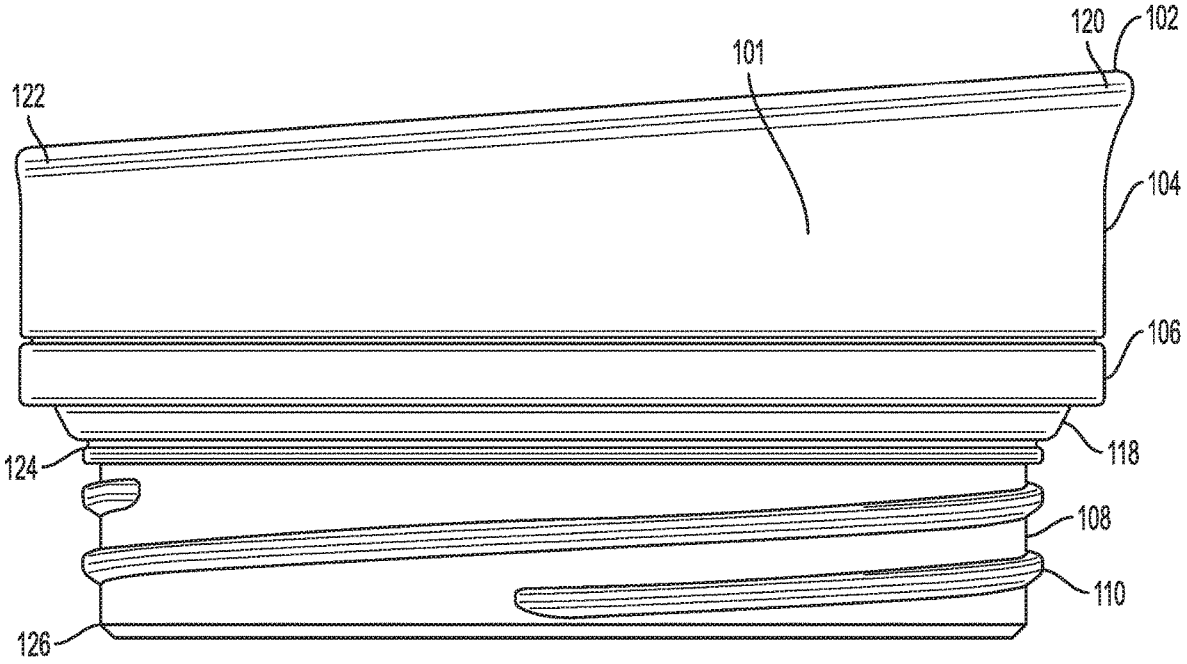
FIG. 3 provides a left side view of a resealable container lid in a closed position according to an exemplary embodiment of the invention.
Figure 4:
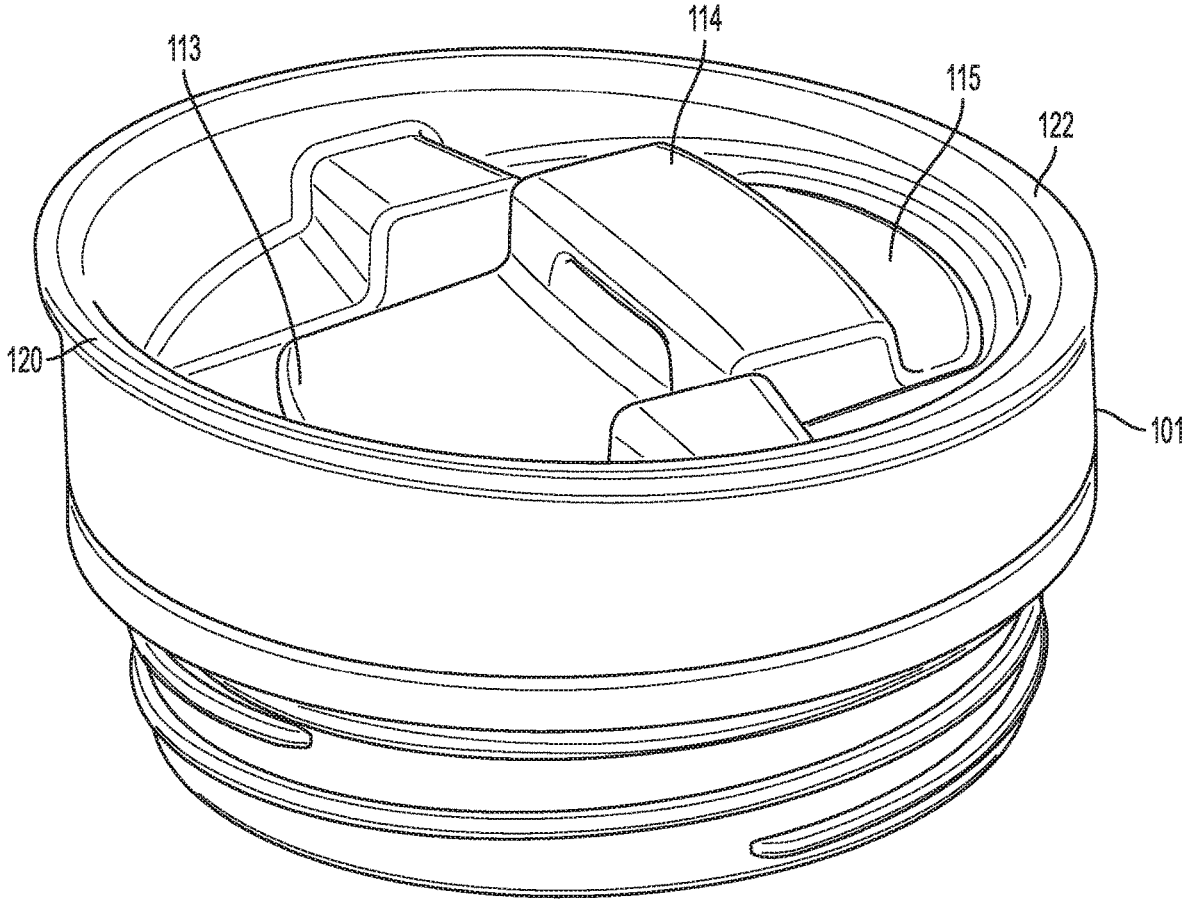
FIG. 4 provides a perspective view of a resealable container lid in an open position according to an exemplary embodiment of the invention.

FIGS. 1-3 depict an exemplary resealable container lid 100 of the present invention in a closed position. Exemplary resealable container lid 100 may have a lid housing 101 that includes a side wall 104 having an upper rim 102 and a lower rim 106. Upper rim 102 may be positioned proximally to, and circumferentially around, top surface 112. Lower rim 106 may be positioned proximal to container connector 108. It is contemplated within the scope of the invention that container connector 108 may be configured to engage any of a variety of different types of container (e.g., a bottle, a coffee cup, a sports bottle, a thermos, a juice container, and the like) via a variety of different connectors such as, for example, a thread 110. It is further contemplated within the scope of the invention that the type of container connector 108 is not limited to thread 110. For example, container connector 108 may be a twist lock connector, a snap fit connector, a friction fit connector, and the like. Resealable container lid 100 may further include sliding actuator 114 positioned within actuator recess 116 in top surface 112. Sliding actuator 114 may be configured to slide back and forth within actuator recess 116. Notably, each of these components may be individually constructed (e.g., via known molding techniques), constructed in various combinations, or constructed as a one piece design (e.g., via 3-D printing or by other similar molding techniques).

Any and all portions of resealable container lid 100 described herein may be made of any suitable material such as, but not limited to, plastic, metal, ceramic, or combinations thereof. Plastics of the present disclosure may include, for example, polyethylene terephthalate (PET), high density polyethylene, low density polyethylene, vinyl, polypropylene, and polystyrene. Additionally, suitable metals of the present disclosure may include aluminum and iron (e.g., steel, stainless steel, and cast iron). Any seal herein disclosed may be made of any suitable sealing material such as, but not limited to rubber, plastic, soft plastic and/or foam.

As shown in FIG. 3, upper rim 102 may be configured so that upper rim front edge 120 is higher than upper rim back edge 122. It is contemplated within the scope of the invention that upper rim 102 may also be configured to have the same height around its circumference. Resealable container lid 100 may also have gasket 118 disposed along the underside of lower rim 106 and adjacent to a container connector upper portion 124 of container connector 108, which also includes a container connector lower portion 126. Gasket 118 may be configured to create a leakproof seal between resealable container lid 100 and any of a variety of containers to which resealable container lid 100 may be connected.

Figure 5:
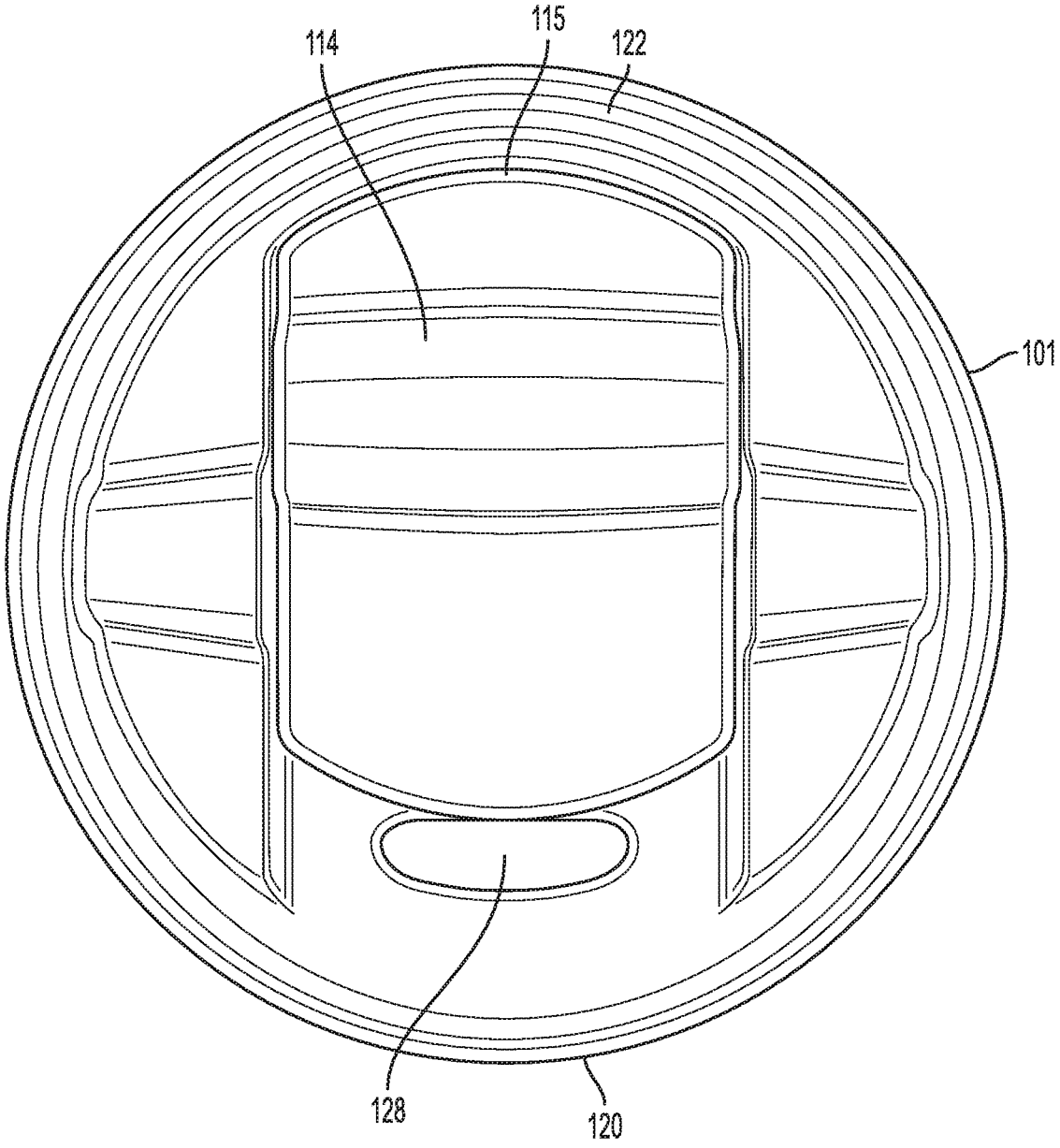
FIG. 5 provides a top view of a resealable container lid in an open position according to an exemplary embodiment of the invention.
Figure 6:
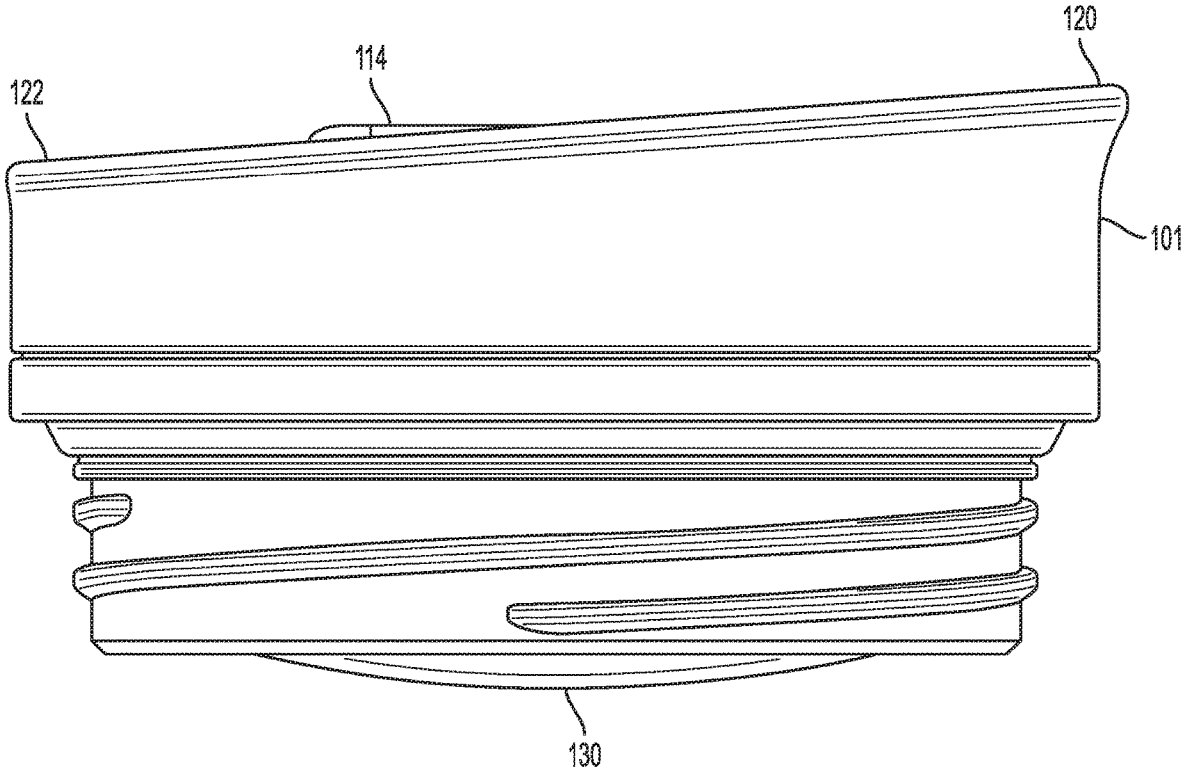
FIG. 6 provides a left side view of a resealable container lid in an open position according to an exemplary embodiment of the invention.
Figure 7:
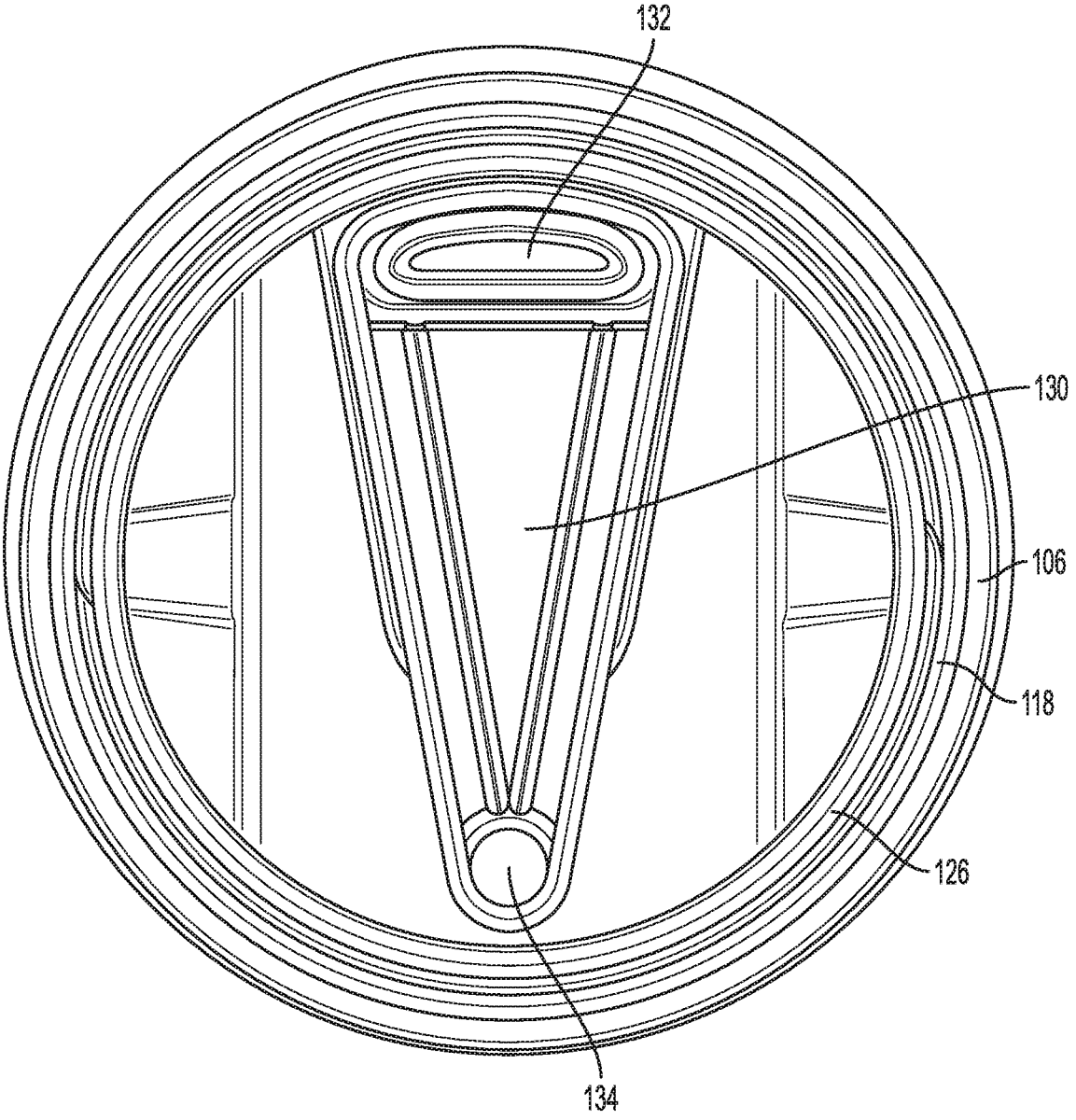
FIG. 7 provides a bottom view of a resealable container lid according to an exemplary embodiment of the invention.

FIGS. 4-7 depict an exemplary resealable container lid 100 of the present invention in an open position in which sliding actuator 114 is moved so that sliding actuator back edge 115 is proximate to upper rim back edge 122 and sliding actuator front edge 113 is pulled away from upper rim front edge 120. As shown in FIG. 5, when sliding actuator 114 is moved rearwardly so that sliding actuator back edge 115 is proximate to upper rim back edge 122, aperture 128 is uncovered. Additionally, when sliding actuator 114 is moved rearwardly, it engages a sealing mechanism 200 (see FIG. 9; described in detail below) that lowers stopper arm 130, which includes stopper 132 and vent plug post 134.

Figure 8:
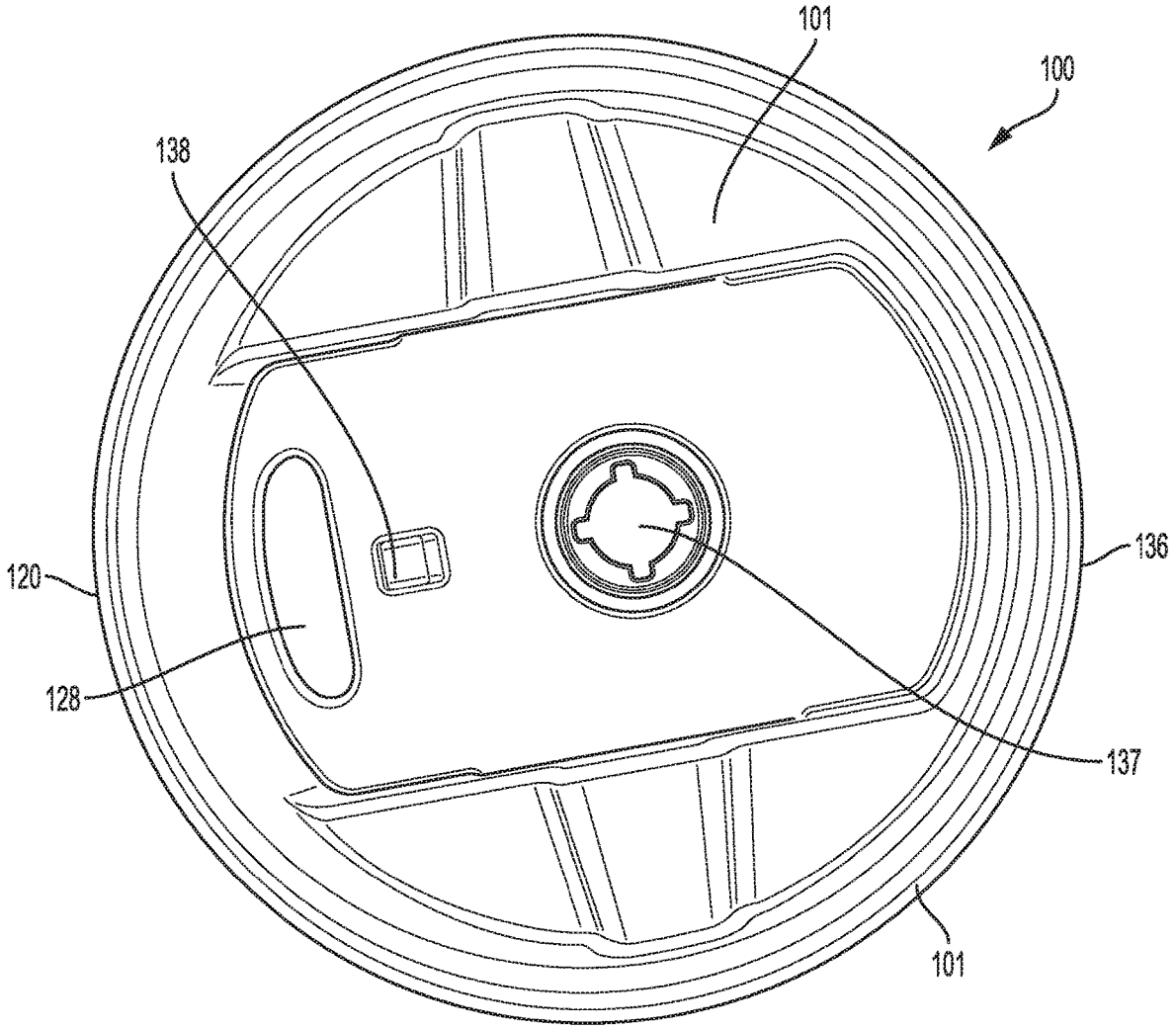
FIG. 8 provides a top view of a partially assembled resealable container lid according to an exemplary embodiment of the invention.

FIG. 8 shows a top view of resealable container lid 100 in which sliding actuator 114 has been removed to show the entirety of lid housing 101 and actuator recess 116, which includes aperture 128, stopper arm post hole 136, and detent 138. While aperture 128 is shown in the exemplary embodiment as being oval, one of skill in the art will appreciate that aperture 128 may be any of a variety of suitable shapes such as, for example, circular, rectangular, square, triangular, etc. Similarly, while aperture 128 is shown in the exemplary embodiment as being positioned proximate to upper rim front edge 120, one of skill in the art will appreciate that the positioning of aperture 128 may be varied as desired. In an illustrative embodiment, the lid may be configured to allow air to vent from lid vent 137. In another illustrative embodiment, container lid 100 may have a lid vent hole (not shown) that may be positioned opposite from aperture 128.

Figure 9:
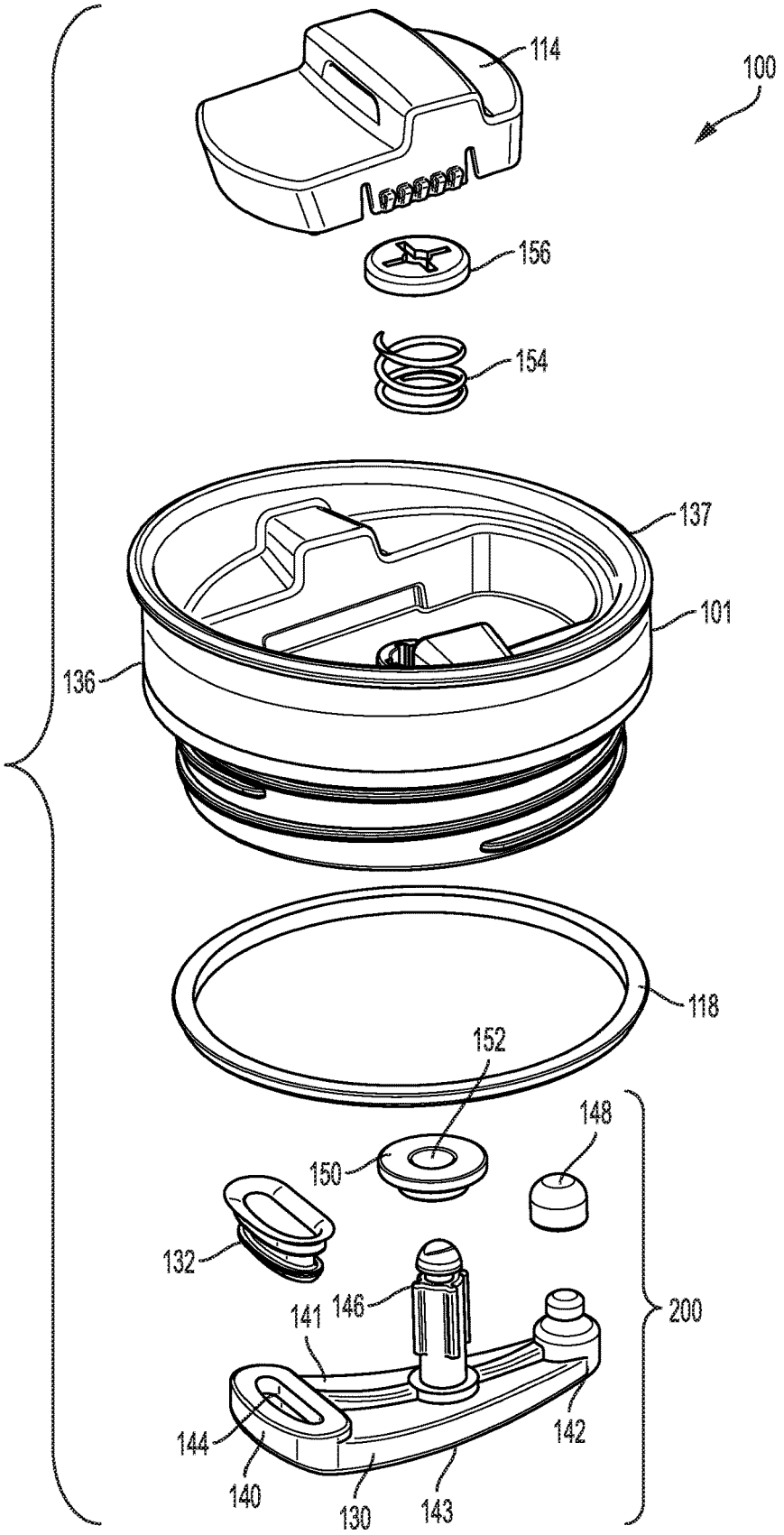
FIG. 9 provides an exploded view of a resealable container lid according to an exemplary embodiment of the invention.

FIG. 9 depicts an exploded view of resealable container lid 100 and, in particular, sealing mechanism 200, which includes stopper arm 130 having a first stopper arm end 140, an upper stopper arm end 141, a second stopper arm end 142, and a lower stopper arm end 143. First stopper arm end 140 includes seating hole 144 in which stopper 132 may be seated. Second stopper arm end 142 includes vent plug post 134, which is configured to receive vent plug 148. Sealing mechanism 200 may also include stopper arm post 146 configured to be inserted through stopper arm post hole 136, and sealing mechanism gasket 150 having opening 152 that is configured to slidably receive stopper arm post 146 so that sealing mechanism gasket 150 rests on upper stopper arm end 141. Sealing mechanism 200 may also include spring 154 retaining clip 156. Material for spring 154 may include any suitable material or combination of materials (e.g., metal, plastic, ceramics, or combinations thereof).

Figure 10:
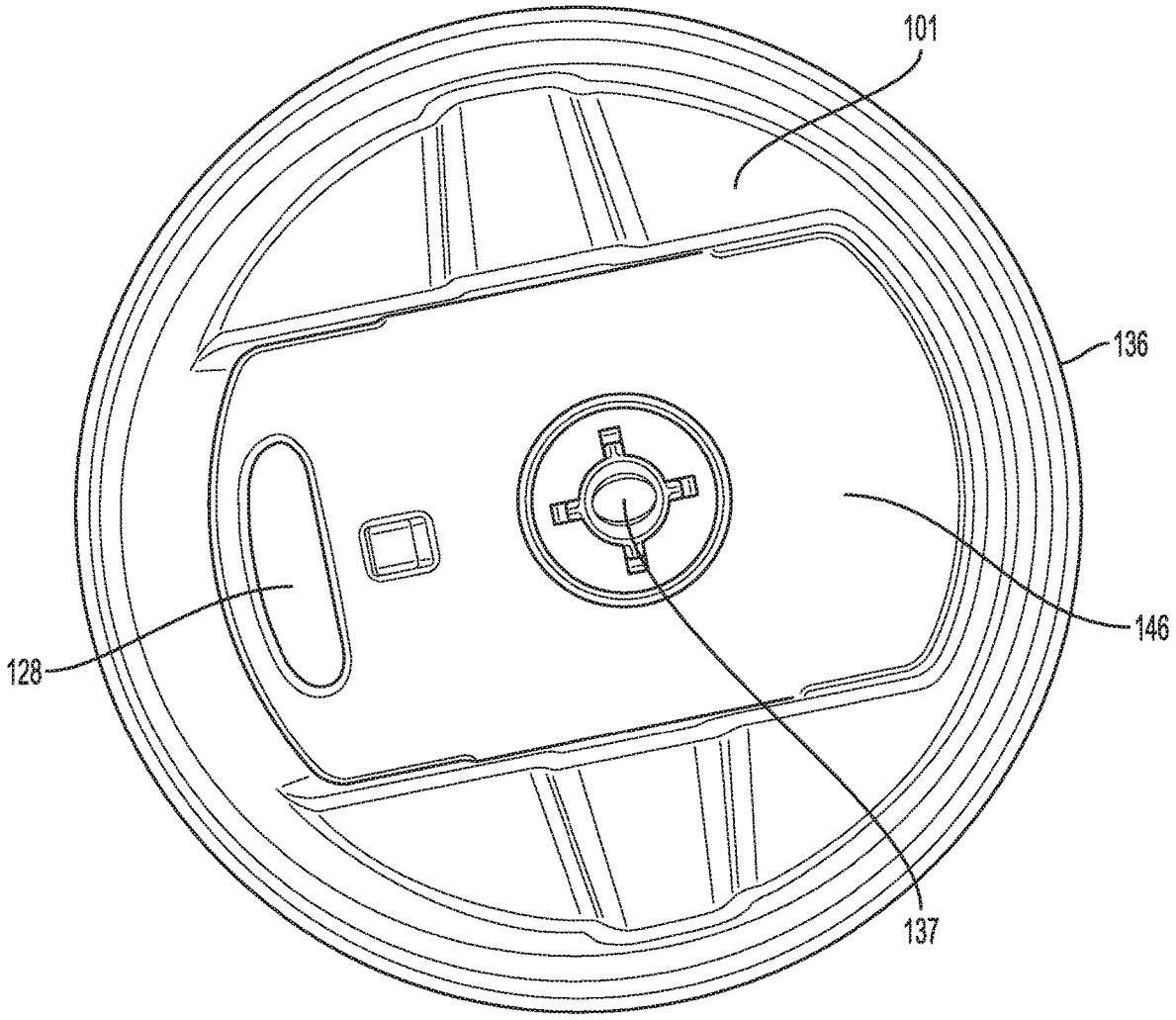
FIG. 10 provides a top view of a partially assembled resealable container lid according to an exemplary embodiment of the invention.

FIG. 10 shows a top view of resealable container lid 100 in which sliding actuator 114 has been removed to show the entirety of actuator recess 116. In this view, a top end of stopper arm post 146 is shown protruding through stopper arm post hole 136 in lid housing 101 after stopper arm post 146 has been slidably received by stopper arm post hole 136. In this illustrative embodiment, lid vent 137 is blocked by stopper arm post 146, thereby preventing air from venting from container lid 100.

Figure 11:
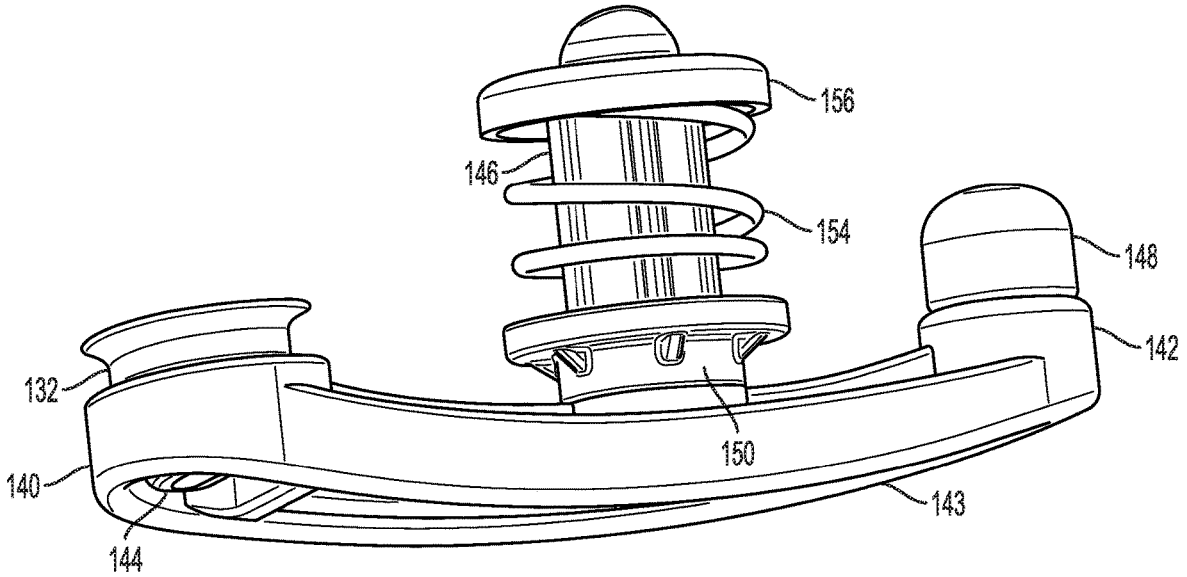
FIG. 11 provides a side view of a portion of a resealing mechanism of a resealable container lid according to an exemplary embodiment of the invention.
Figure 12:
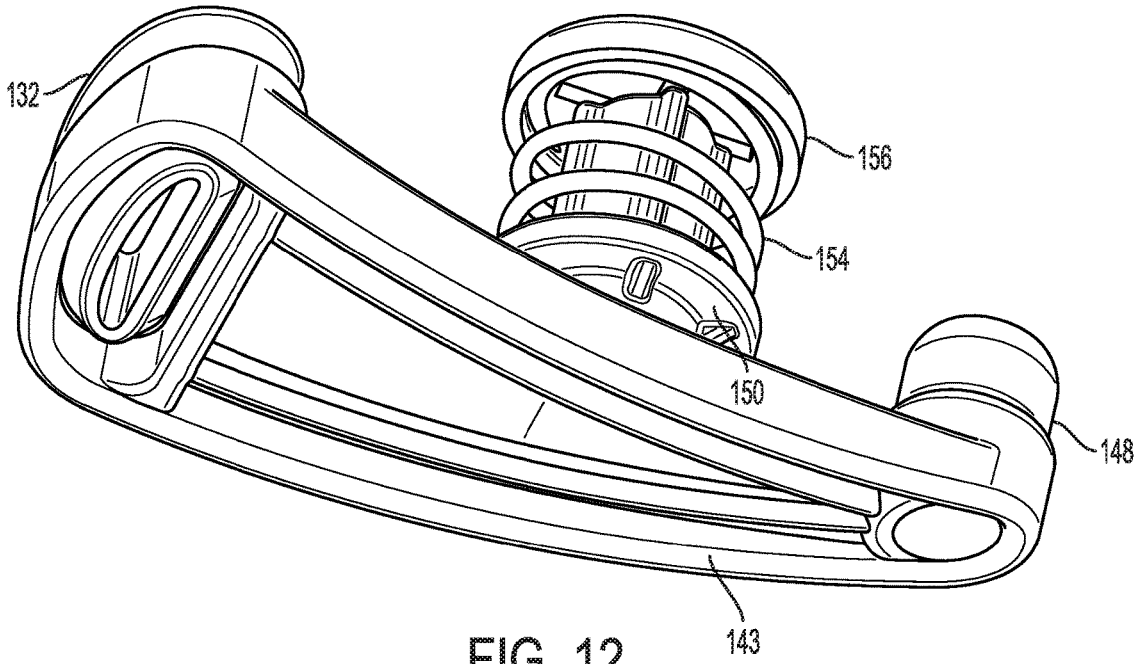
FIG. 12 provides a side view of a portion of a resealing mechanism of a resealable container lid according to an exemplary embodiment of the invention.

FIGS. 11 and 12 depict an assembled view of sealing mechanism 200 in which lid housing 101 has been removed. As noted above, sealing mechanism 200 includes stopper arm 130 configured to receive stopper 132 on first stopper arm end 140 within seating hole 144 and configured to receive vent plug 148 on vent plug post 134 positioned on second stopper arm end 142. Sealing mechanism 200 includes stopper arm post 146 configured to be inserted through stopper arm post hole 136 in lid housing 101. For example, as shown in FIG. 9, in the context of resealable container lid 100, top surface 112 of lid housing 101 would normally be disposed around stopper arm post 146 via slidable engagement with stopper arm post hole 136 and positioned between spring 154 and sealing mechanism gasket 150. Retaining clip 156 may be configured to retain spring 154 around stopper arm post 146.

Figure 13:
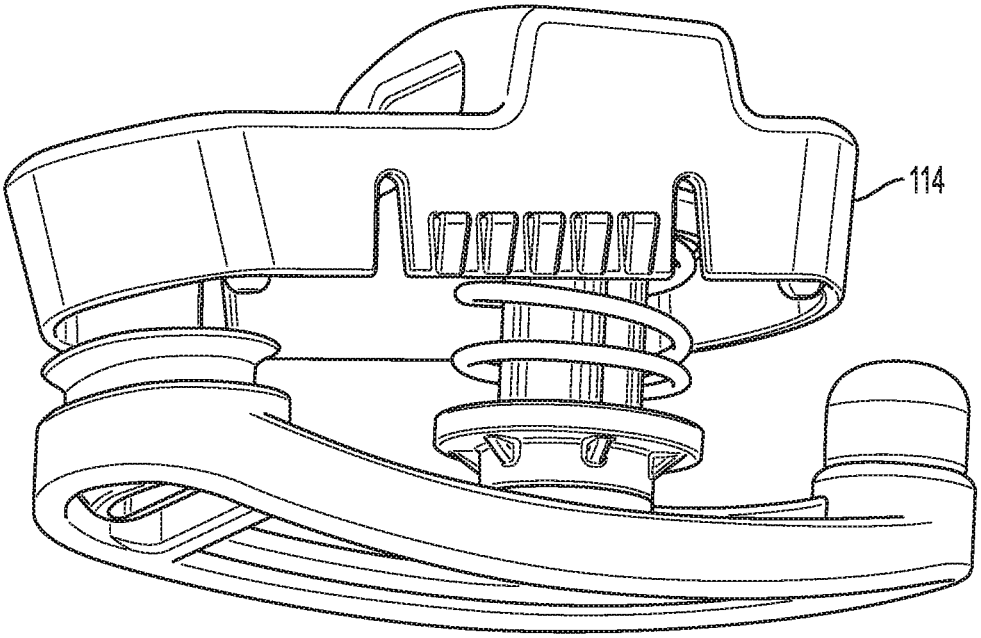
FIG. 13 provides a side view of a portion of a resealing mechanism of a resealable container lid including a sliding actuator in the closed position according to an exemplary embodiment of the invention.
Figure 14:
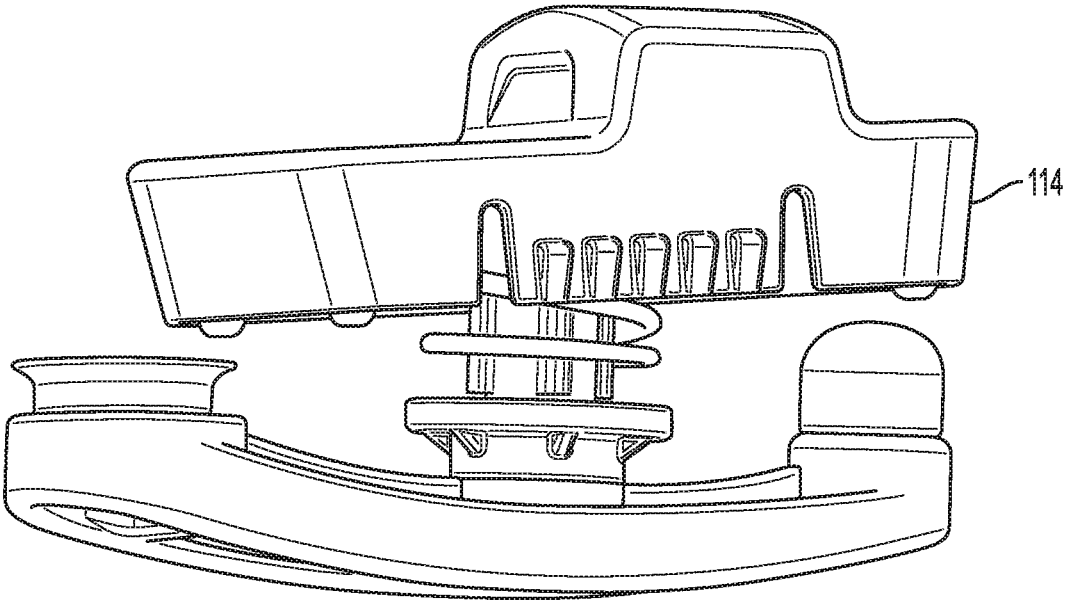
FIG. 14 provides a side view of a portion of a resealing mechanism of a resealable container lid including a sliding actuator in the open position according to an exemplary embodiment of the invention.

FIGS. 13 and 14 show an assembled view of sealing mechanism 200 in the closed and open positions, respectively, that includes sliding actuator 114 but excludes lid housing 101. For example, FIG. 13 shows that when sliding actuator 114 is in the forward position, spring 154 is fully extended and stopper 132, as well as vent plug 148 are positioned proximate to sliding actuator 114 in a manner that would abut the bottom side of lid housing 101 (not shown in FIG. 13). However, as shown in FIG. 14, when sliding actuator 114 is moved rearwardly, spring 154 is compressed against the top side of lid housing 101 (not shown in FIG. 14), thereby moving stopper 132 and vent plug 148 in a downward direction via stopper arm post 146.

Figure 15:
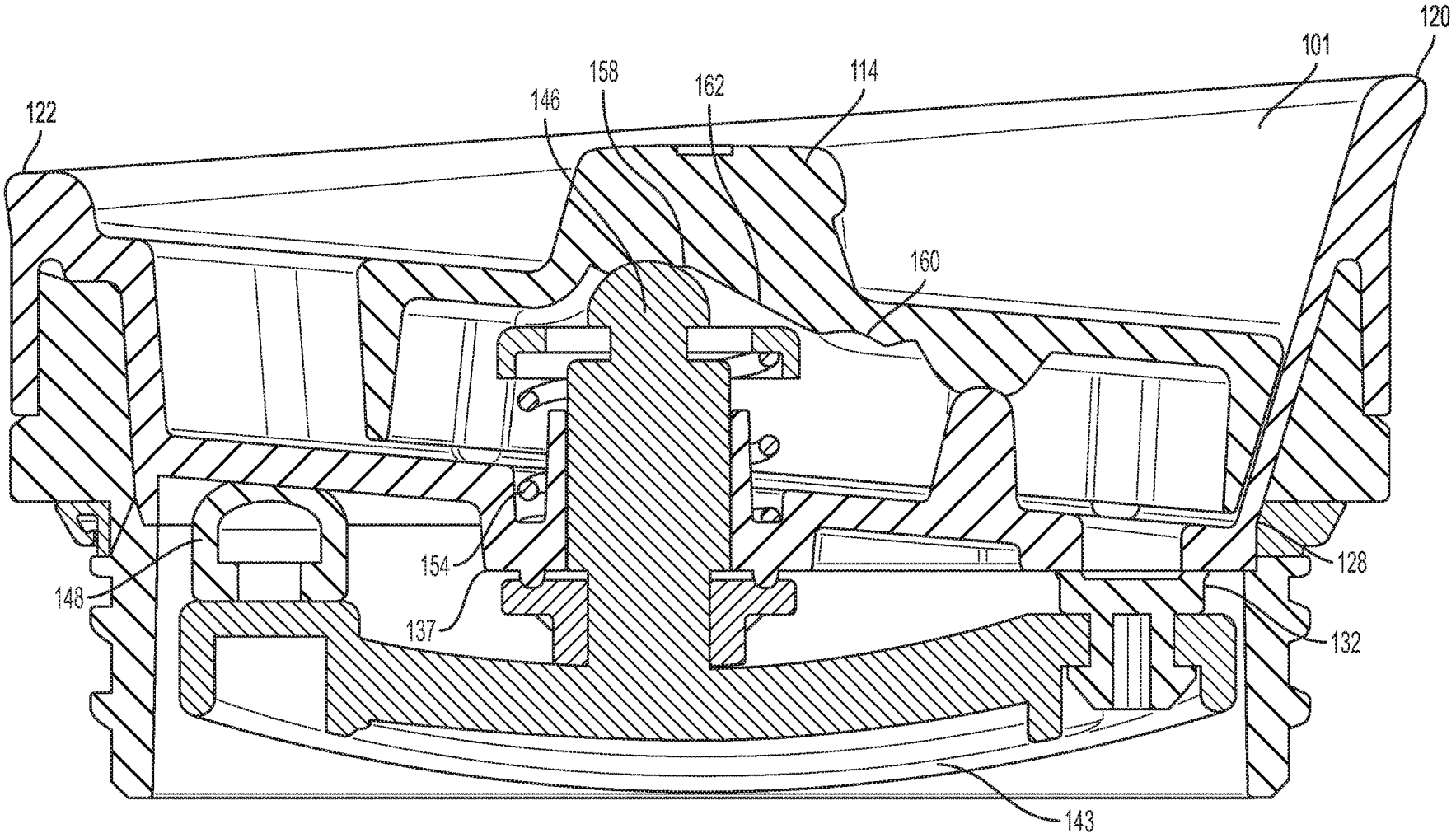
FIG. 15 provides a cross sectional view of an assembled resealable container lid in the closed position according to an exemplary embodiment of the invention.

FIG. 15 shows a cross-section of an assembled resealable container lid 100 in the closed position. When sliding actuator 114 is moved to the forward position, top portion of stopper arm post 146 engages with a first stop 158 positioned on the underside of sliding actuator 114. As shown in FIG. 15, a second stop 160 is also positioned on the underside of sliding actuator 114 in a position slightly more forward then first stop 158. First stop 158 and second stop 160 are connected by ramp 162. In an exemplary embodiment, when sliding actuator 114 is in the forward position and stopper arm post 146 is engaged with/seated in first stop 158, no pressure is placed upon spring 154 and stopper 132 and vent plug 148 are seated tightly against the underside of lid housing 101, thereby sealing aperture 128. Additionally, in the closed position, lid vent 137 may be block to that air flow is minimized/blocked from passing from the inside of the container through container lid 100 by going past stopper arm 146.

Figure 16:
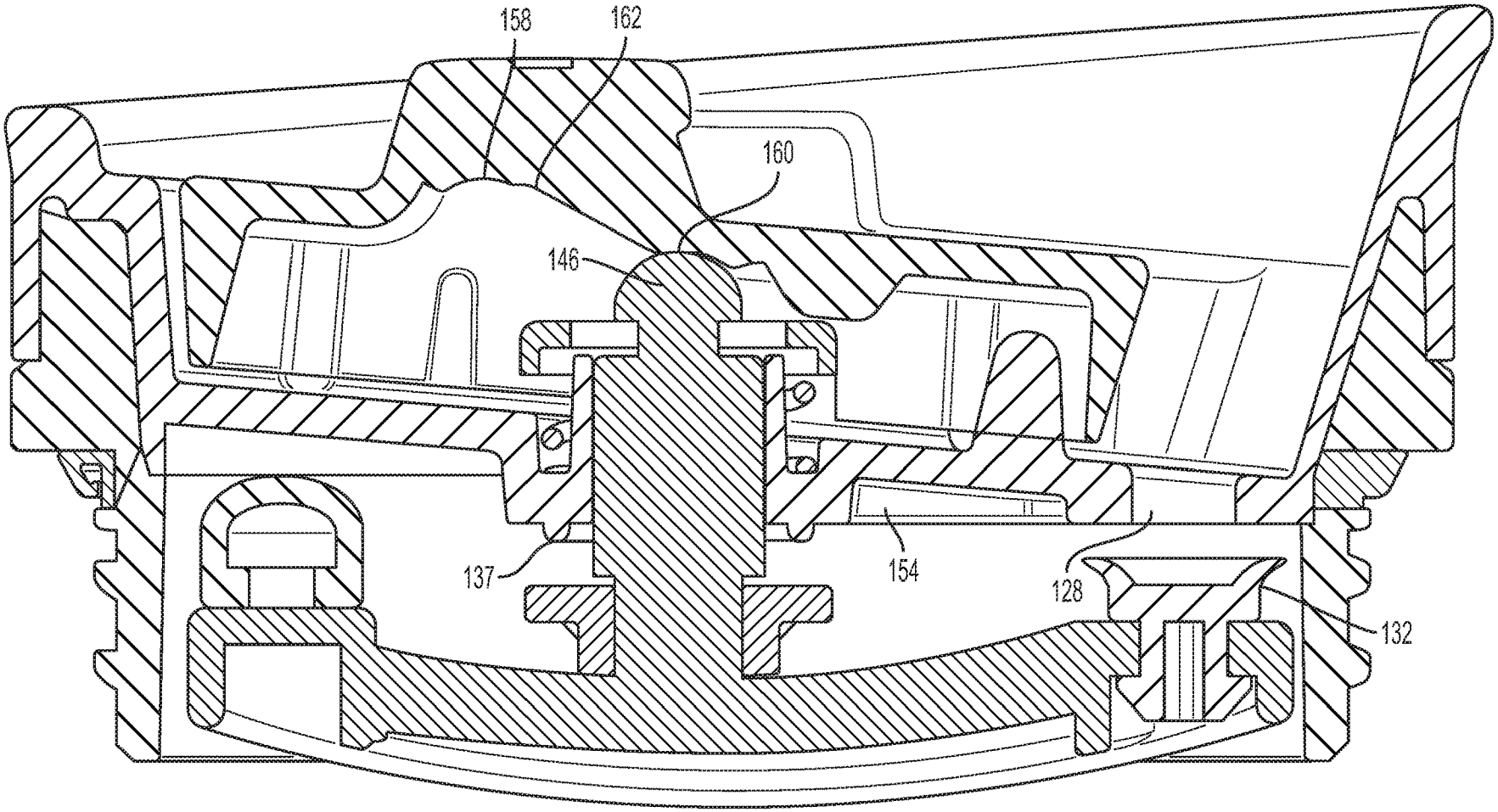
FIG. 16 provides a cross sectional view of an assembled resealable container lid in the open position according to an exemplary embodiment of the invention.

FIG. 16 shows a cross-section of an assembled resealable container lid 100 in the open position. When sliding actuator 114 is moved to the rearward position, top portion of stopper arm post 146 slides along ramp 162, thereby compressing spring 154 against the top surface of lid housing 101, until the top portion of stopper arm post 146 engages with second stop 160. In this position, stopper arm post 146 is moved into a downward position that disengages stopper 132 and vent plug 148 from the underside of housing 101, thereby unsealing aperture 128. In this position, aperture 128 may serve as a fluid connection port to allow liquid in a container (e.g. a coffee cup) to pass from the container through aperture 128 and into a user's mouth. Additionally, in the open position, lid vent 137 is unblocked so that air flow may occur from the inside of the container through container lid 100 by going past stopper arm 146.

EQUIVALENTS

Although preferred embodiments of the invention have been described using specific terms, such description is for illustrative purposes only, and it is to be understood that changes and variations may be made without departing from the spirit or scope of the following claims.

The invention claimed is:

1. A container lid, comprising:

a lid housing having a recess, a rim, an opening, and a connector portion;

a sliding actuator that moves in a first direction and a second direction, wherein the sliding actuator comprises a first stop and a second stop; and a sealing mechanism that moves in a third direction and a fourth direction, wherein the third direction and the fourth direction are in a plane of movement which is perpendicular to the first direction and the second direction, wherein the sealing mechanism comprises a stopper arm post;

wherein the first stop receives the stopper arm post when the sliding actuator is moved in the first direction such that the stopper arm post is engaged with or seated in the first stop in a first position, and the second stop receives the stopper arm post when the sliding actuator is moved in the second direction such that the stopper arm post is engaged with or seated in the second stop in a second position.

2. The container lid of claim 1, wherein the sealing mechanism is coupled to the sliding actuator.

3. The container lid of claim 1, wherein the sealing mechanism comprises a sealing arm, wherein one end of the stopper arm post is connected to an upper surface of the sealing arm at an approximately medial position.

4. The container lid of claim 1, wherein the sealing mechanism further comprises a stopper, wherein the opening is blocked by the stopper in the first position, and wherein the opening is unblocked in the second position.

* * * * *